US008161862B1

(12) United States Patent
Pinckney et al.

(10) Patent No.: US 8,161,862 B1
(45) **Date of Patent: *Apr. 24, 2012**

(54) HYBRID LAMINATED TRANSPARENT ARMOR

(75) Inventors: Linda Ruth Pinckney, Corning, NY (US); Jian-Zhi Jay Zhang, Ithaca, NY (US)

(73) Assignee: Corning Incorporated, Corning, NY (US)

( * ) Notice: Subject to any disclaimer, the term of this patent is extended or adjusted under 35 U.S.C. 154(b) by 904 days.

This patent is subject to a terminal disclaimer.

(21) Appl. No.: 11/974,028

(22) Filed: Oct. 11, 2007

Related U.S. Application Data

(60) Provisional application No. 60/879,158, filed on Jan. 8, 2007.

(51) Int. Cl.
*F41H 5/04* (2006.01)

(52) U.S. Cl. ..... 89/36.02; 89/905

(58) Field of Classification Search ..... 89/36.01–36.17, 89/36.02; 428/911; 501/4, 5, 7, 10
See application file for complete search history.

(56) References Cited

U.S. PATENT DOCUMENTS

| | | | | |
|---|---|---|---|---|
| 2,227,770 | A * | 1/1941 | Ungewiss | 428/164 |
| 3,615,759 | A * | 10/1971 | Busdiecker et al. | 501/7 |
| 3,635,739 | A * | 1/1972 | MacDowell et al. | 501/10 |
| 3,650,720 | A * | 3/1972 | Grego et al. | 428/38 |
| 3,656,984 | A * | 4/1972 | Hoffman | 501/74 |
| 3,725,283 | A * | 4/1973 | Fenity | 430/111.2 |
| 3,785,833 | A * | 1/1974 | Rapp | 501/2 |
| 4,473,653 | A * | 9/1984 | Rudoi | 501/4 |
| 4,940,674 | A | 7/1990 | Beall et al. | |
| 5,045,371 | A | 9/1991 | Calkins | 428/49 |
| 5,060,553 | A | 10/1991 | Jones | 89/36.02 |
| H001061 | H * | 6/1992 | Rozner et al. | 89/36.02 |
| H001519 | H * | 3/1996 | Semple | 89/36.02 |
| 5,496,640 | A | 3/1996 | Bolton et al. | 428/421 |
| H001567 | H * | 8/1996 | Parsons et al. | 89/36.02 |
| 6,297,179 | B1 * | 10/2001 | Beall et al. | 501/10 |
| 6,376,402 | B1 * | 4/2002 | Pannhorst et al. | 501/66 |
| 6,479,155 | B1 * | 11/2002 | Gelderie et al. | 428/426 |
| 6,708,595 | B1 | 3/2004 | Chaussade et al. | |
| 7,101,819 | B2 * | 9/2006 | Rosenflanz et al. | 501/41 |
| 7,147,544 | B2 * | 12/2006 | Rosenflanz | 451/28 |
| 7,258,707 | B2 * | 8/2007 | Celikkaya et al. | 501/32 |

(Continued)

FOREIGN PATENT DOCUMENTS

GB 2284655 6/1995

(Continued)

OTHER PUBLICATIONS

Millett, et al.; "The behaviour of a SiO2-LiO2 glass ceramic during one-dimensional shock loading"; J. Phys. D: Appl. Phys. 38 (2005) 3530-3536.

(Continued)

*Primary Examiner* — Michael Carone
*Assistant Examiner* — Jonathan C Weber
(74) *Attorney, Agent, or Firm* — Walter M. Douglas

(57) ABSTRACT

A transparent armor laminate system is described that utilizes a glass-ceramic material as the strike-face material, one or a plurality of intermediate layers, and a backing material. This laminate system offers improved performance with reduced weight over conventional all-glass or all-glass-ceramic transparent armor systems. The glass-ceramic material consists of a glass phase and a crystalline phase, the crystalline phase being selected from a group consisting of beta-quartz, mullite and combinations thereof.

15 Claims, 3 Drawing Sheets

U.S. PATENT DOCUMENTS

| | | | | |
|---|---|---|---|---|
| 7,510,585 | B2 * | 3/2009 | Rosenflanz | 51/309 |
| 7,514,149 | B2 * | 4/2009 | Bocko et al. | 428/426 |
| 7,584,689 | B2 * | 9/2009 | Jones et al. | 89/36.02 |
| 7,681,485 | B2 * | 3/2010 | Neal | 89/36.02 |
| 7,875,565 | B1 * | 1/2011 | Pinckney et al. | 501/4 |
| 2003/0126802 | A1 * | 7/2003 | Rosenflanz | 501/41 |
| 2003/0126804 | A1 * | 7/2003 | Rosenflanz et al. | 501/41 |
| 2003/0150321 | A1 * | 8/2003 | Lucuta et al. | 89/36.02 |
| 2003/0188553 | A1 * | 10/2003 | Mann et al. | 65/30.1 |
| 2004/0197575 | A1 * | 10/2004 | Bocko et al. | 428/432 |
| 2005/0119104 | A1 | 6/2005 | Alexander et al. | 501/14 |
| 2007/0068375 | A1 * | 3/2007 | Jones et al. | 89/36.02 |
| 2007/0068376 | A1 * | 3/2007 | Jones et al. | 89/36.02 |
| 2010/0031810 | A1 * | 2/2010 | Neal | 89/36.02 |

FOREIGN PATENT DOCUMENTS

| | | |
|---|---|---|
| GB | 2379659 A | 3/2003 |
| WO | 03/022767 | 3/2003 |

OTHER PUBLICATIONS

Swab; "Recommendations for Determining the Hardness of Armor Ceramics"; Int. J. Appl. Ceram. Technol., 1 [3] 219-25 (2004).

Hasselman, et al.; "Proposed Fracture Theory of a Dispersion-Strengthened Glass Matrix"; Journal of the American Ceramic Society, vol. 49, No. 2 68-72 (1966).

Patel, et al.; "Transparent Armor Materials: Needs and Requirements"; Ceramic Armor Materials by Design, vol. 134, Copyright 2002; pp. 573-586.

* cited by examiner

HYBRID LAMINATED TRANSPARENT ARMOR

PRIORITY

This application claims the priority of U.S. Provisional Application No. 60/879,158 filed Jan. 8, 2007 and titled HYBRID LAMINATED TRANSPARENT ARMOR.

GOVERNMENT RIGHTS

This invention was made with United States Government support under Agreement No. HR0011-05-C-0127 awarded by DARPA. The United States Government has certain rights in this invention.

FIELD OF THE INVENTION

The invention is directed to a hybrid laminated transparent armor system, and in particular to a composite armor containing a glass-ceramic material and a conventional glass material.

BACKGROUND OF THE INVENTION

Transparent materials that are used for ballistic protection (armor) include (1) conventional glasses, for example, soda lime and borosilicate glass which are typically manufactured using the float process; (2) crystalline materials such as aluminum oxy-nitride (ALON), spinel, and sapphire; and (3) glass-ceramic materials ("GC"). In the last category, a transparent lithium disilicate GC from Alstom, known as TransArm, has been studied by several groups. Due to its superior weight efficiency against ball rounds and small fragments, TransArm has the potential to increase performance of protective devices such as face shield; studies of the shock behavior of these materials have shown that the GC has a high post-failure strength compared to that of amorphous glasses. See GB 2 284 655 A; PCT International Patent Publication WO 03/022767 A1; and J. C. F. Millett, N. K. Bourne, and I. M. Pickup, *The behaviour of a $SiO_2$-$Li_2O$ glass ceramic during one-dimensional shock loading*, J. Phys. D: Appl. Phys. 38, 3530-3536 (2005). Other prior art includes (1) U.S. Pat. No. 5,060,553 and (2) U.S. Pat. No. 5,496,640 which describe, respectively, (1) armor material based on glass-ceramic bonded to an energy-absorbing, fiber-containing backing layer, and (2) fire- and impact-resistant transparent laminates comprising parallel sheets of glass-ceramic and polymer, with intended use for security or armor glass capable of withstanding high heat and direct flames. Additional patent or patent application art includes U.S. Pat. No. 5,045,371 titled Glass Matrix Armor (describing a soda-lime glass matrix with particles of ceramic dispersed throughout, the ceramic not being grown in situ in the glass) and U.S. Patent Application US 2005/0119104 A1 (2005) titled Protection From Kinetic Threats Using Glass-Ceramic Material (describing an opaque armor based on anorthite ($CaAl_2Si_2O_8$) glass-ceramics).

SUMMARY OF THE INVENTION

In one aspect, using ballistics testing of various combinations of glass, glass-ceramic, and polycarbonate layering, we have discovered that the combination of a hard transparent GC strike-face with one or more intermediate layers of glass or GC provides significantly better ballistics performance as a function of areal density than does an all-GC or all-glass design. We have seen no reference in the prior art to the benefits of this particular configuration.

In one embodiment, the invention is directed to a transparent armor laminate system. The laminate system comprises at least one glass-ceramic material layer, at least one glass layer, and a backing layer (also called a spalling layer); wherein the glass-ceramic layer has a crystalline component and a glass component, the crystalline component being in the range of 20-98 Vol. % of the glass-ceramic and the glass component being in the range of 2-20 Vol. %. The laminate system is made using transparent bonding materials between the glass-ceramic, glass and backing layers. Bonding materials known in the art, for example, epoxy materials, can be used.

In another aspect the invention is directed to the use of laminations of transparent GCs with glass for various armor systems; for example, armor systems for ground vehicles and aircraft as well as for personal protective devices. The optical properties of these armor systems meet the visible transparency as well as near IR transparency requirements of military armor systems, and their moderate density combined with a higher ballistics limit offers either of two important attributes or a combination of both attributes which are:

(1) The ability to achieve ballistics performance equivalent to that of glass, with lower thickness, thereby providing critically-needed lower weight for armor systems; and (2) The ability to achieve superior ballistics performance with the same laminate thickness used for current transparent armor.

DETAILED DESCRIPTION OF THE INVENTION

As used herein the term, strike-face, is used to signify the face of the laminate armor that receives the incoming projectile.

It is generally recognized that a material's hardness and fracture toughness contribute to its ballistic performance, although the exact correlation between static material properties and ballistic performance is still elusive after decades of research (see J. J. Swab, *Recommendations for Determining the Hardness of Armor Ceramics*, Int. J. Applied Ceram. Technol., Vol. 1 (3) (2004), pages 219-225). One hypothesis is that an ideal armor material needs to have sufficient hardness to break up the projectile, but above a certain threshold value, hardness no longer dictates performance. If optimization of other mechanical properties such as fracture toughness can be achieved while the hardness is above the threshold value, armor performance can be optimized as well.

Figure 1:
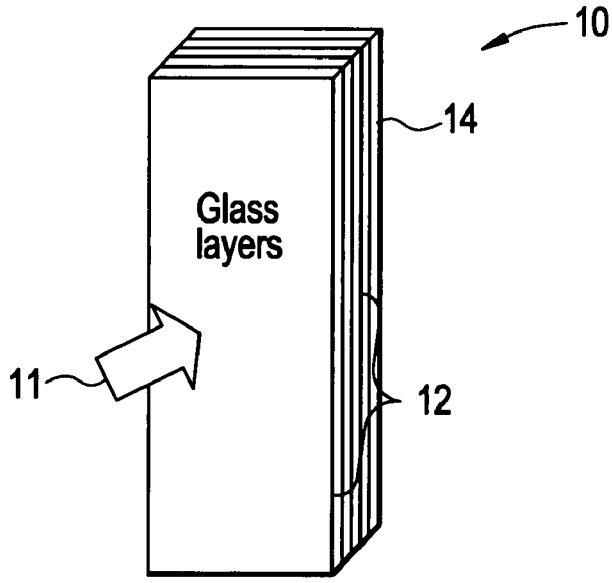
FIG. 1 is an illustration of a typical commercially available armor system composed of glass and a polycarbonate backing.

As illustrated in FIG. 1, a typical commercial transparent armor system 10 consists of a one or a plurality of layers (the first four layer in the FIG. 1) of glass 12 or transparent crystalline material) laminated into a composite layered structure with a polymer material 14 as backing or "spall catcher" as illustrated in FIG. 1 as the back-most layer. The number of layers and order of layers in the composite structure depends upon the threat types the armor system is designed to defeat. The typical transparent glass materials used for these layers are conventional glasses, such as soda lime and borosilicate glasses, typically manufactured using conventional float glass processing. Transparent crystalline materials are usually ALON (aluminum oxynitride), spinel and sapphire. The gray arrow 11 in FIG. 1 indicates the path of an incoming projectile.

While transparent crystalline ALON, spinel and sapphire have all demonstrated weight efficiencies greater than three times better than glass, meaning the armor system can stop the same projectiles with less than one-third the total weight of a glass-based system, these crystalline materials require the use of expensive powder processing (ALON and spinel) or crystal growth (sapphire) methods to make the materials. These methods are intrinsically very expensive, have low product yields, result in materials that are very costly to finish/polish, and are not conducive to making large size sheets of transparent materials that are required for uses such as windows. In addition, if curved sheets are required for a particular application, this requirement would add further complexity and cost. As a result, these high performance materials are mainly used in research laboratories, and are rarely used in real-world situations.

Glass offers significant cost benefits over crystalline materials that require high temperature processing. However, in order to increase the ballistic performance of glass armor, more layers and/or thicker glass has to be added. As a result, the overall armor weight has become more and more unbearable to the "user" whether a person or a vehicle. There is consensus that a fundamental solution lies in the use of innovative materials, not more of the same glass.

Figure 2:
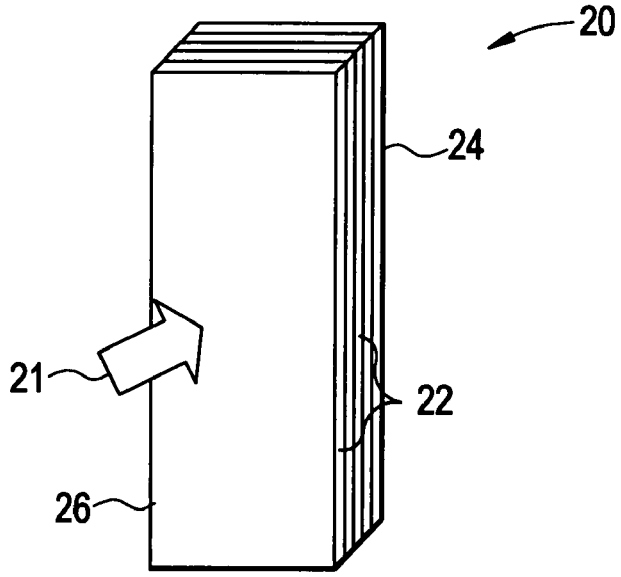
FIG. 2 is an illustration of the invention generally illustrating the use of a glass-ceramic strike-face, one or a plurality of glass layers and a polycarbonate backing.

As a class of material, GCs combine the manufacturability of glass with many of the property benefits of crystalline materials. GCs offer significant advantages over conventional glass in resisting the penetration of projectiles that include armor piercing (hard steel core) bullets. In ballistics testing of various combinations of glass, GC, and polycarbonate layering we have discovered that the combination of a hard transparent glass-ceramic strike-face with one or more intermediate layers of glass provides significantly better ballistics performance as a function of areal density than does an all-glass-ceramic or an all-glass design. FIG. 2 is an illustration of a laminated armor 20 of the invention having a hard glass-ceramic strike-face 26 (first or front-most layer), a plurality of glass layers 22 (next three layers) and a backing 24 (back most layer). The backing comprises an anti-spalling material such as a tough polymer. Polycarbonate is frequently used as a backing. An advantage of the system represented by 20 is that in addition to stopping projectiles (represented by arrow 21) at a preset velocity (e.g., muzzle velocity for certain type of bullets) they would require less material—in thickness or areal density—than conventional glass laminates and even glass-ceramic/glass-ceramic laminates. The gray arrow 21 in FIG. 2 indicates the path of an incoming projectile.

Figure 3:
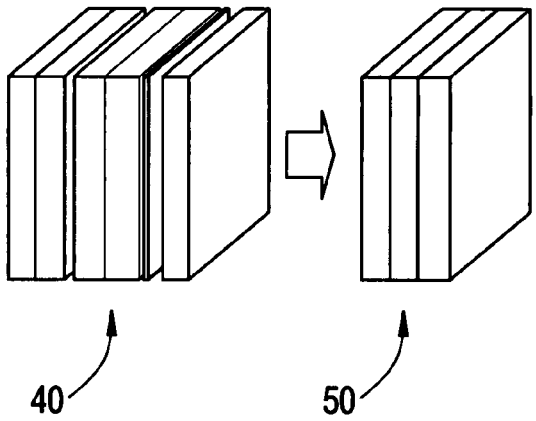
FIG. 3 illustrates a lightweight glass-ceramic/glass as compared to an all float glass system as is commercially available.

In addition to offering lower weight compared to glass-only laminate and lower cost compared to crystalline materials, the hybrid configuration in the present invention requires much less total glass-ceramic thickness: for example, 10-20 mm thickness of glass-ceramic compared to an alternative glass-ceramic only solution that would require at least 30 mm total glass-ceramic thickness. The lower material requirement of the present invention greatly facilitates manufacturability of the glass-ceramic from an optical transmission standpoint. Many glass-ceramics are prone to absorption problems due to the fact that small amount of impurities present in the glass, such as iron oxide, tend to react with $TiO_2$ (a typical nucleation agent) to cause absorption in the blue end of the visible spectrum. FIG. 3 illustrates the difference, and hence the weight savings through layer reductions that can be obtained using a GC/glass laminate 50 (right side of figure) as compared to an "all float glass" system 40 (left side of figure).

Glass-ceramics are microcrystalline solids produced by the controlled devitrification of glass. Glasses are melted, fabricated to shape, and then converted by a heat treatment to a partially-crystalline material with a highly uniform microstructure. Thus, glass-ceramics contain a crystalline component and a glass component. The basis of controlled crystallization lies in efficient internal nucleation, which allows development of fine, randomly oriented grains without voids, micro-cracks, or other porosity. Like glass and ceramics, GCs are brittle materials which exhibit elastic behavior up to the strain that yields breakage. Because of the nature of the crystalline microstructure, however, mechanical properties including strength, elasticity, fracture toughness, and abrasion resistance are higher in GCs than in glass. Glass-ceramics found useful for transparent armor application contain 20-98 Vol. % crystalline component and 2-80 Vol. % glass component while maintaining their transparency.

As noted above the exact correlation of static material properties and ballistic performance is poorly understood. One hypothesis is that an ideal armor material must have sufficient hardness to break up the projectile, but above a threshold value hardness no longer dictates performance. This hypothesis is supported by the moderate, but by no means impressive, Knoop hardness values of 700-730 that are obtained, for example, with spinel GCs. The microstructure of transparent GCs typically includes 10-40 nm crystals dispersed substantially uniformly throughout the glass-ceramic. The crystals may be dispersed in a "softer," continuous glassy, that is, amorphous phase that remains after heat treatment. This microstructure can provide enhanced ballistics protection. Hasselman and Fulrath ("*Proposed fracture theory of a dispersion-strengthened glass matrix*, J. Am. Ceram. Soc., 49 (1966), pp. 68-72) proposed a fracture theory wherein hard spheroidal crystalline dispersions within a glass will limit the size of flaws which can be produced on the surface, thereby leading to an increase in strength. The microstructure, strength and moderate hardness of GCs may explain their efficacy as a strike-face in glass-GC hybrid laminates.

Figure 4:
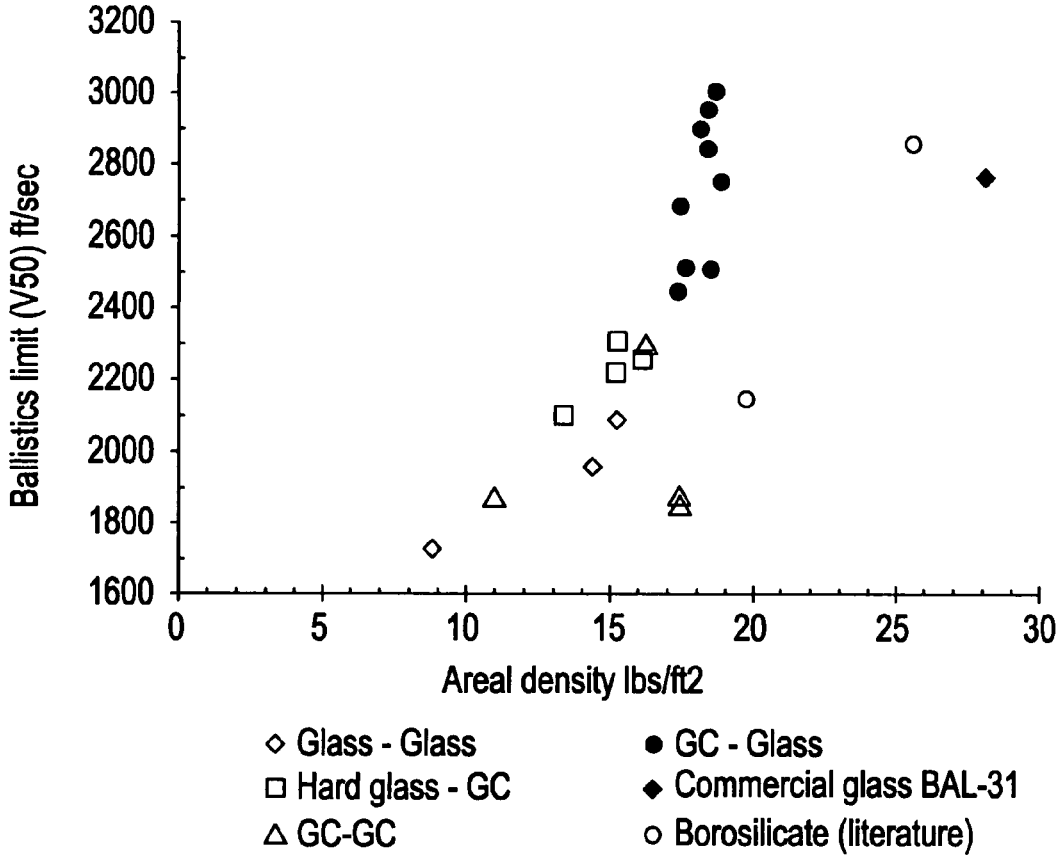
FIG. 4 is a graph of ballistic velocity vs. areal density illustrating the superiority of a glass-ceramic/glass armor system of the invention over other types of systems.
Figure 5:
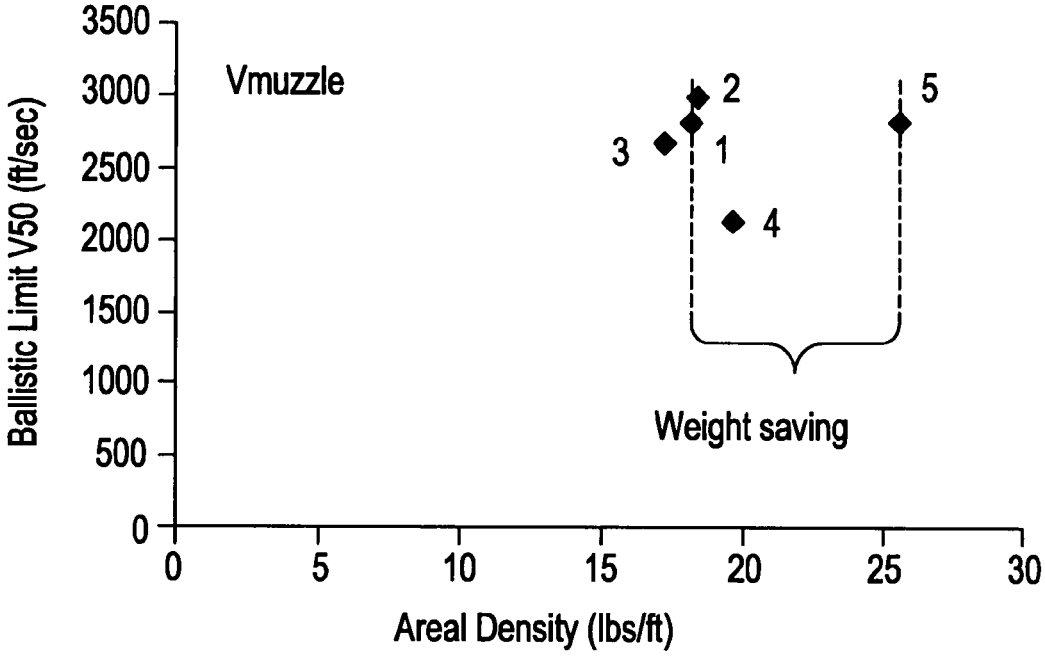
FIG. 5 is a graph illustrating the weight savings that can be achieved using a glass-ceramic/glass laminate as opposed to an all glass laminate.

Ballistic results for a variety of glass and GC laminate configurations are illustrated in the graph in FIG. 4. In all laminates used in FIG. 4, a one-half inch, (~1.27 cm) soft polycarbonate backing was used in conjunction with the glass and/or glass-ceramic materials. FIG. 4 is a plot of the AP ballistic limit (ability to stop armor-piercing bullets in units of ft/sec) against laminate areal density (in units of $lbs/ft^2$). The black circles represent various GC-glass configurations. Corresponding data for commercial glass laminates are taken from the literature (*Ceramic Armor Materials by Design*, ed., J. W. McCauley Ed., *Ceramic Transactions*, Vol. 134 (2002). Preferably, a high ballistics limit will occur at a low areal density. FIG. 5 is a graph illustrating the weight savings of a hybrid GC-glass laminate compared to that of an all-glass laminate. The boxes to the right illustrate the relative thickness of the GC and glass (grey and white, respectively) for each data point. Boxes 1-4 represent laminates of comparable total thickness and areal density. Box 1 has the greatest thickness of glass-ceramic material and Box 3 has the smallest thickness of glass-ceramic material. Box 4 is all glass. Box 5 represents an all glass laminate of greater thickness than that of Box 4.

The glass-ceramic part of the laminate system should be chosen to have good transparency and minimal light transmission losses or distortion in the selected transmission regions (for example without limitation, in the visible, infrared and ultraviolet ranges). The exact percentage of the phases, crystalline and glass, depend on the composition of the glass before ceramming and the precise heat treatment used to crystallize the glass. Any glass material that can be cerammed according to the foregoing teachings and the teachings elsewhere herein can be used as the glass-ceramic component of the armor laminate. In addition the glass-ceramic material should have a Knoop hardness of at least 600. The desired microstructure and crystallinity level in the glass-ceramic will likely depend on the types of threat that will be encountered and the multi-hit pattern that is being sought. Examples of the glass-ceramics include, without limitation, glass-ceramics in which the crystalline component includes beta-quartz, a spinel and mullite.

The glass component of the armor laminate can consist of one or a plurality of glass layers, each layer having a thickness in the range of 5-50 mm. In one embodiment each individual glass layer of the one or plurality of glass layers has a thickness in the range of 10-20 mm. The glass material can be any glass meeting the criteria of transmissivity and low distortion as described elsewhere herein. Examples of such glass include but are not limited to soda-lime glass; silica glass, borosilicate glass; and aluminoborosilicate glass.

The "spall catcher" or "backing" material used in the armor laminates is typically selected from polymeric materials such as acrylates, polycarbonates, polyethylenes, polyesters, polysulfones and other polymeric materials as used in currently available transparent armor. As with the glass-ceramic materials and the glasses used in the armor laminates of the invention, the spall catcher materials must meet the criteria of transmissivity and low distortion as described elsewhere herein.

Examples

In one embodiment transparent armor laminate has a glass-ceramic layer, one or a plurality of glass layers and a backing or spall catcher layer, the individual layers having a thickness in the range of 10-20 mm. The Knoop hardness of the glass-ceramic material is greater than 600. In an additional embodiment, the Knoop hardness is greater than 700.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. A transparent armor laminate comprising a plurality of layers including a strike-face layer comprising a glass-ceramic, a backing layer comprising a spall-resistant material, and at least one intermediate layer comprising glass and laminated between the strike face and the backing;

wherein the glass-ceramic comprises 20-98 Vol. % crystalline component and 2-80 Vol. % glass component and the crystalline component is selected from the group consisting of beta-quartz, mullite and combinations thereof.

2. The transparent armor of claim 1, wherein the crystalline component has a particle size from 10-40 nm.

3. The transparent armor of claim 1, wherein the crystalline component is dispersed substantially uniformly within the glass component.

4. The transparent armor of claim 1, wherein the glass-ceramic has a Knopp hardness of at least 600.

5. The transparent armor of claim 1, wherein the spall-resistant material comprises a polymer.

6. The transparent armor of claim 5, wherein the polymer includes polycarbonate.

7. The transparent armor of claim 1, wherein the intermediate layer comprises a plurality of layers including a glass layer and at least one additional layer comprising a material selected from a group consisting of glass and glass-ceramic.

8. The transparent armor of claim 1, wherein the glass is selected from a group consisting of soda-lime glass, silica glass, borosilicate glass, aluminoborosilicate glass, and mixtures thereof.

9. The transparent armor of claim 1, wherein the armor has a thickness of less than 50 mm.

10. The transparent armor of claim 1, wherein each layer as a thickness of from 5-50 mm.

11. A transparent armor laminate comprising a plurality of layers including a strike-face layer comprising a glass-ceramic, a backing layer comprising a polymer, and a plurality of intermediate layers comprising glass, the intermediate layers laminated between the strike face layer and the backing layer;

wherein the glass-ceramic comprises 20-98 Vol. % crystalline component and 2-80 Vol. % glass component.

12. The transparent armor of claim 11, wherein the crystalline component includes crystals having a particle size from 10-40 nm that are dispersed substantially uniformly within the glass component.

13. The transparent armor of claim 11, wherein at least one intermediate layer comprises a glass-ceramic.

14. A transparent armor laminate comprising a plurality of layers including a strike-face layer comprising a glass-ceramic having 20-98 Vol. % crystalline component and 2-80 Vol. % glass component, a backing layer comprising polycarbonate, and a plurality of intermediate layers laminated between the strike face layer and the backing layer, and at least one intermediate layer comprising glass.

15. The transparent armor of claim 14, wherein the crystalline component is selected from a group consisting of beta-quartz, mullite, and combinations thereof, and has a particle size from 10-40 nm that is dispersed substantially uniformly within the glass component.

* * * * *